US006660706B1

(12) United States Patent
Koester et al.

(10) Patent No.: US 6,660,706 B1
(45) Date of Patent: Dec. 9, 2003

(54) GENERAL PURPOSE CLEANERS

(75) Inventors: Rita Koester, Duesseldorf (DE); Ansgar Behler, Bottrop (DE); Karl-Heinz Schmid, Mettmann (DE); Michael Neuss, Cologne (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/857,916

(22) PCT Filed: Nov. 30, 1999

(86) PCT No.: PCT/EP99/09286

§ 371 (c)(1),
(2), (4) Date: Oct. 2, 2001

(87) PCT Pub. No.: WO00/34425

PCT Pub. Date: Jun. 15, 2000

(30) Foreign Application Priority Data

Dec. 9, 1998 (DE) ..... 198 56 727

(51) Int. Cl.[7] ..... C11D 1/02; C11D 1/66; C11D 1/75; C11D 1/90; C11D 1/94

(52) U.S. Cl. ..... 510/423; 510/191; 510/238; 510/245; 510/264; 510/274; 510/220; 510/221; 510/224; 510/237; 510/424; 510/433; 510/501; 510/502; 510/503; 510/506

(58) Field of Search ..... 510/191, 238, 510/245, 264, 274, 220, 221, 224, 237, 423, 424, 433, 501, 502, 503, 506

(56) References Cited

U.S. PATENT DOCUMENTS

| | | | | |
|---|---|---|---|---|
| 1,985,424 A | | 12/1934 | Piggott | 260/124 |
| 2,016,962 A | | 10/1935 | Flint et al. | 260/127 |
| 2,703,798 A | | 3/1955 | Schwartz et al. | 260/211 |
| 4,624,803 A | | 11/1986 | Balzer et al. | 252/527 |
| 4,690,779 A | * | 9/1987 | Baker et al. | 252/546 |
| 4,925,587 A | | 5/1990 | Schenker et al. | 252/174.22 |
| 5,205,959 A | | 4/1993 | Schmid et al. | 252/174.17 |
| 5,501,813 A | * | 3/1996 | Fischer et al. | 252/174.17 |
| 5,753,606 A | | 5/1998 | Hees et al. | 510/422 |
| 5,759,987 A | | 6/1998 | Haerer et al. | 510/514 |
| 5,871,590 A | * | 2/1999 | Hei et al. | 134/26 |
| 5,876,514 A | * | 3/1999 | Rolando et al. | 134/25.2 |
| 6,124,250 A | * | 9/2000 | Olson et al. | 510/108 |
| 6,200,941 B1 | * | 3/2001 | Strandburg et al. | 510/238 |

FOREIGN PATENT DOCUMENTS

| | | |
|---|---|---|
| AU | 9894119 | 6/1999 |
| DE | 39 14 131 A1 | 10/1990 |
| DE | 39 28 600 A1 | 3/1991 |
| DE | 39 28 602 A1 | 3/1991 |
| DE | 43 23 252 C2 | 1/1995 |
| DE | 43 26 112 A1 | 2/1995 |
| DE | 37 23 323 C2 | 3/1998 |
| EP | 0 161 537 A2 | 11/1985 |
| EP | 0 689 582 B1 | 1/1996 |
| EP | 0 921 187 A2 | 6/1999 |
| JP | 09 013079 A | 1/1997 |
| WO | WO 92/06984 | 4/1992 |
| WO | WO 96/12001 | 4/1996 |
| WO | WO 00/02983 | 1/2000 |

OTHER PUBLICATIONS

Derwent WPI, Derwent Publications Ltd., London, GB, Accession No. 1997–129137, XP–002131339, Abstract of JP 09 013079, Lion Corp., Jan. 14, 1997.

Ploog, "Amphotere Tenside, Aufbau, Eigenschaften und Anwendungsmöglichkeiten", Seifen–Öle–Fette–Wachse, vol. 198, (Jul. 15, 1982), pp. 373–376.

O'Lenick, et al., "A Review of the Chemistry and Applications", Amphoteric Surfactants, HAPPI, (Nov., 1986), pp. 70–74, 125 & 126.

Holzman, et al., "Amphoteric Surfactants of the Amphoglycinate and Amphocarboxyglycinate Type", Amphoteric Surfactants, Tenside Detergents, vol. 23, Carl Hanser Verlag, München, (1986), pp. 309–313.

Bilbo, et al., "A Structure Function Study", Amphoteric Surfactants, Soap/Cosmetics/Chemical Specialties, (Apr., 1990), pp. 46, 48, 50, 114 & 116.

Busch, et al., "Natürliche Bestandteile in Kosmetischen", Euro Cosmetics, vol. 1, (1994), pp. 15–20.

Heike Kelkenberg, "Neue Komponenten für Waschrohstoffe und Kosmetika", Detergenzien auf Zuckerbasis, Tenside Surfactants Detergents, vol. 25, Carl Hanser Verlag, München, (1988), pp. 8–13.

Wischpflegemittel, Qualitätsnormen für Fussbodenpflege– und –reinigungsmittel, Seifen–Öle–Fette–Wachse, vol. 112, (Oct., 1986), pp. 371–372.

* cited by examiner

*Primary Examiner*—Gregory Delcotto
(74) *Attorney, Agent, or Firm*—John F. Drach; Steven J. Trzaska

(57) ABSTRACT

Multipurpose cleaners are comprised of an alkoxylated carboxylic acid ester corresponding to the formula (I):

$$R^1\underset{\underset{O}{\|}}{C}(OAlk)_nOR^2 \quad (I)$$

wherein $R^1CO$ is an aliphatic acyl group, AlkO is $CH_2CH_2O$, $CHCH_3CH_2O$, $CH_2CHCH_3O$, or a combination thereof, n is a number from 1 to 20 and $R^2$ is an aliphatic alkyl group, and a betaine, an amine oxide or a combination thereof.

14 Claims, No Drawings

GENERAL PURPOSE CLEANERS

BACKGROUND OF THE INVENTION

The present invention relates to multipurpose cleaners containing alkoxylated carboxylic acid esters, more particularly those which have been obtained by reaction of carboxylic acid esters and alkylene oxides in the presence of calcined hydrotalcites, and—as co-surfactants—betaines and/or amine oxides. The present invention also relates to the use of a surfactant mixture containing alkoxlated carboxylic acid esters and betaines and/or amine oxides for the production of the multipurpose cleaners.

Compositions for cleaning hard non-textile surfaces—except tableware—in the home and in the institutional sector are known as multipurpose cleaners (MPCs). Low-foaming MPCs are those which, when used manually, generate a small volume of foam which collapses significantly in a matter of minutes. Products of this type are well-known and are established on then market. They are essentially aqueous surfactant solutions of various kinds with or without added builders, hydrotropes or solvents. Although consumers like the cleaning solution to foam to a certain extent at the, beginning of the particular cleaning task as proof of effectiveness, they also want the foam to collapse quickly so that cleaned surfaces do not have to be re-wiped. To this end, compositions of the type mentioned are normally formulated with low-foaming nonionic surfactants, for example mixed ethers or alcohol alkoxylates, more particularly oxoalcohol ethoxylates.

DE-A-43 26 112 describes low-foaming multipurpose cleaners which, besides the high-foaming alkyl polyglycosides, also contain fatty acid alkyl ester alkoxylates. Multipurpose cleaners such as these combine high cleaning performance with very low foaming.

Unfortunately, known compositions often lack dermatological compatibility so that, despite a large number of commercially available products, there is a constant need among manufacturers and customers alike for milder preparations which at least reach the standard of known products in regard to foaming and cleaning behavior. Accordingly, the problem addressed by the present invention was to meet these requirements.

SUMMARY OF THE INVENTION

The present invention relates to multipurpose cleaners containing (a) alkoxylated carboxylic acid esters corresponding to formula (I):

$$R^1\underset{\underset{O}{\|}}{C}(OAlk)_nOR^2 \qquad (I)$$

in which $R^1CO$ is an aliphatic acyl group, AlkO stands for $CH_2CH_2O$, $CHCH_3CH_2O$ and/or $CH_2CHCH_3O$, n is a number of 1 to 20 and $R^2$ is an aliphatic alkyl group, and (b) betaines and/or amine oxides.

It has surprisingly been found that the compositions according to the invention are flowable and low-foaming, even in highly concentrated form, can readily be diluted with water without passing through a gel phase and—largely irrespective of their concentration—do not irritate the skin land still show excellent cleaning performance, above all excellent fat dissolving power.

DETAILED DESCRIPTION OF THE INVENTION

Alkoxylated Carboxylic Acid Esters

Alkoxylated carboxylic acid esters, which are a compulsory constituent of the MPCs according to the invention, are known from the prior art. They may be obtained, for example, by esterification of alkoxylated carboxylic acids with alcohols. For the purposes of the present invention, however, the compounds are produced by reaction of carboxylic acid esters with alkylene oxides using catalysts, more especially calcined hydrotalcite in accordance with DE-A-39 14 131, which give compounds with a narrow homolog distribution. Alkoxylated carboxylic acid esters of general formula (I), in which $R^1CO$ is an aliphatic acyl group containing 6 to 22 carbon atoms, AlkO stands for a $CH_2CH_2O$—, $CHCH_3CH_2O$— and/or $CH_2$—$CHCH_3O$ group, n has an average value of 3 to 20 and $R^2$ is an aliphatic alkyl group containing 1 to 22 carbon atoms, are preferred for the purposes of the present invention.

Preferred acyl groups are derived from carboxylic acids containing 6 to 22 carbon atoms of natural or synthetic origin, more especially from linear, saturated and/or unsaturated fatty acids, including the technical mixtures thereof obtainable by lipolysis from animal and/or vegetable fats and oils, for example from coconut oil, palm kernel oil, palm oil, soya oil, sunflower oil, rapeseed oil, cottonseed oil, fish oil, bovine tallow and lard. Examples of such carboxylic acids are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and/or erucic acid. More particularly, $R^1CO$ is a linear, even-numbered acyl group containing 8 to 18 carbon atoms.

Preferred alkyl groups are derived from primary, aliphatic monohydric alcohols containing 1 to 22 carbon atoms which may be saturated and/or unsaturated. Examples of suitable monoalcohols are methanol, ethanol, propanol, butanol, pentanol and the hydrogenation products of the above-mentioned carboxylic acids containing 6 to 22 carbon atoms. More particularly, $R^2$ is a methyl group.

AlkO preferably stands for a $CH_2CH_2O$ group.

Alkoxylated carboxylic acid esters of formula (I), in which $R^1CO$ is a linear, even-numbered acyl group containing 8 to 18 carbon atoms, AlkO stands for a $CH_2CH_2O$ group, n has an average value of 5 to 15 and $R^2$ is a methyl group, are particularly suitable. Examples of such compounds are carboxylic acid acid methyl esters alkoxylated with, on average, 5, 7, 9, 10 or 11 moles of ethylene oxide.

If particularly low-viscosity multipurpose cleaners are required, it is advisable to use alkoxylated carboxylic acid esters derived from short-chain carboxylic acids, more particularly those containing 8 to 10 carbon atoms. By contrast, high cleaning performance is obtained from alkoxylated carboxylic acid esters derived from relatively long-chain carboxylic acids, more particularly those containing 12 to 18 carbon atoms.

Component b) is compulsorily present in the multipurpose cleaners according to the invention. In one embodiment, betaines are present as component b).

Betaines

Betaines are known surfactants which are mainly produced by carboxyalkylation, preferably carboxymethylation, of aminic compounds. The starting materials are preferably condensed with halocarboxylic acids or salts thereof, more particularly with sodium chloroacetate, 1 mole of salt being formed per mole of betaine. The addition of unsaturated carboxylic acids, for example acrylic acid, is also possible. Information on the nomenclature and, in particular, on the difference between betaines and "true" amphoteric surfactants can be found in the article by U. Ploog. in Seifen-Öle-Fette-Wachse, 198, 373 (1982). Other overviews on this subject have been published, for example, by A. O'Lennick et al. in HAPPI, November 70 (1986), by S. Holzman et al. in Tens. Surf. Det. 23, 309 (1986), by R. Bilbo et al. in Soap Cosm. Chem. Spec. Apr. 46 (1990) and by P. Ellis et al. in Euro Cosm. 1, 14 (1994).

In one embodiment, the betaines present are carboxyalkylation products of secondary and, in particular, tertiary amines which correspond to formula (II):

(II)

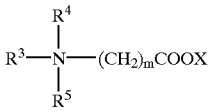

in which $R^3$ represents alkyl and/or alkenyl groups containing 6 to 22 carbon atoms, $R^4$ represents hydrogen or alkyl groups containing 1 to 4 carbon atoms, $R^5$ represents alkyl groups containing 1 to 4 carbon atoms, m is a number of 1 to 6 and X is an alkali metal and/or alkaline earth metal or ammonium ion. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof.

In another embodiment, suitable betaines are also carboxyalkylation products of amidoamines corresponding to formula (III):

(III)

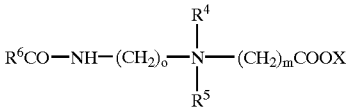

in which $R^6CO$ is an aliphatic acyl group containing 6 to 22 carbon atoms and 0 or 1 to 3 double bonds, o is a number of 1 to 3 and $R^4$, $R^5$, m and X are as defined above for formula (II). Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl aminoethyl amine, N,N-dimethyl aminopropyl amine, N,N-diethyl aminoethyl amine, and N,N-diethyl aminopropyl amine which are condensed with sodium chloroacetate. A condensation product of $C_{8/18}$ cocofatty acid-N, N-dimethyl aminopropyl amide with sodium chloroacetate is preferably used.

Other suitable starting materials for the betaines to be used in accordance with the invention are imidazolines corresponding to formula (IV):

(IV)

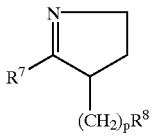

in which $R^7$ is an alkyl group containing 5 to 21 carbon atoms, $R^8$ is a hydroxyl group, an $OCOR^7$ or $NHCOR^7$ group and p is 2 or 3. These imidazolines are also known substances which may be obtained, for example, by cyclizing condensation of 1 or 2 moles of fatty acid with polyfunctional amines, for example aminoethyl ethanolamine (AEEA) or diethylenetriamine. The corresponding carboxyalkylation products are mixtures of different open-chain betaines. Typical examples are condensation products of the above-mentioned fatty acids with AEEA, preferably imidazolines based on lauric acid or $C_{12/14}$ cocofatty acid, which are subsequently betainized with sodium chloroacetate.

Amine Oxides

Finally, the cleaners according to the invention may contain amine oxides in admixture with, or instead of, the betaines as component (b). Amine oxides are produced from tertiary fatty amines, which normally contain either one long and two short or two long and one short alkyl chain, by oxidation in the presence of hydrogen peroxide. The amine oxides suitable for use in accordance with the present invention correspond to formula (V):

(V)

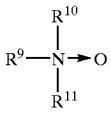

in which $R^9$ is a linear or branched alkyl group containing 12 to 18 carbon atoms and $R^{10}$ and $R^{11}$ independently of one another have the same meaning as $R^9$ or represent an optionally hydroxy-substituted alkyl group containing 1 to 4 carbon atoms. Amine oxides corresponding to formula (V), in which $R^9$ and $R^{10}$ represent $C_{12/14}$ or $C_{12/18}$ cocoalkyl groups and $R^{11}$ is a methyl group or a hydroxyethyl group, are preferably used. Amine oxides corresponding to formula (V), in which $R^9$ is a $C_{12/14}$ or $C_{12/18}$ cocoalkyl group and $R^{10}$ and $R^{11}$ represent a methyl or hydroxyethyl group, are also preferred.

Components a) and b) may be present in the multipurpose cleaners according to the invention in a ratio by weight of 10:90 to 90:10 and preferably in a ratio by weight of 30:70 to 70:30. In one particular embodiment, the ratio by weight of a) to b) is in the range from 60:40 to 90:10. The ratio of betaines to amine oxides in component b) is not so critical and, accordingly, may vary within wide limits.

Anionic surfactants may be additionally present as component c) in the multipurpose cleaners according to the invention. Typical examples of anionic surfactants suitable as component c) are soaps, alkyl benzenesulfonates, alkane sulfonates, olefin sulfonates, alkyl ether sulfonates, glycerol ether sulfonates, α-methyl ester sulfonates, sulfofatty acids, alkyl sulfates, alkyl ether sulfates, glycerol ether sulfates, monoglyceride (ether) sulfates, hydroxy mixed ether sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products), fatty acid polyglycol ester sulfates and alkyl (ether) phosphates. Where the anionic surfactants contain polyglycol ether chains, they may have a conventional homolog distribution although they preferably have a narrow homolog distribution. Preferred anionic surfactants are alkali metal soaps, alkyl sulfates, alkyl benzene sulfonates, alkyl ether sulfates, monoglyceride sulfates, fatty acid polyglycol ester sulfates and/or sulfosuccinates, alkyl sulfates and/or alkyl ether sulfates being most particularly preferred.

Fatty alcohol sulfates and fatty alcohol ether sulfates (component c) are known anionic surfactants which are industrially produced by sulfation of primary alcohols or addition products thereof with ethylene oxide with $SO_3$ or chlorosulfonic acid and subsequent neutralization. Fatty alcohol (ether) sulfates corresponding to formula (VI):

$$RO—(CH_2CH_2O)_aSO_3Y \quad (VI)$$

in which R is a linear or branched alkyl and/or alkenyl group containing 6 to 22 carbon atoms, a is a number of 1 to 10 and Y is an alkali metal and/or alkaline earth metal, ammonium, alkyl ammonium, alkanolammonium or glucammonium, are suitable for the purposes of the invention. Typical examples of fatty alcohol sulfates are the sulfates of caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium and/or magnesium salts. Typical examples of fatty alcohol ether sulfates are the sulfation products of the adducts of on average 1 to 10 and more particularly 2 to 5 moles of ethylene oxide with the above-mentioned alcohols. It is particularly preferred to use coconut fatty alcohol ether sulfate and fatty alcohol ether sulfates based on adducts of on average 2 to 3 moles of ethylene oxide with technical $C_{12/14}$ or $C_{12/18}$ coconut fatty alcohol fractions in the form of their sodium and/or magnesium salts.

Besides the alkoxylated carboxylic acid esters described under a), the multipurpose cleaners according to the invention may optionally contain other nonionic surfactants as component d). Typical examples of other nonionic surfactants suitable as component d) are mixed ethers, hydroxy mixed ethers, fatty alcohol polyglycol ethers, alkyl phenol polyglycol ethers, fatty acid amide polyglycol ethers, fatty amine polyglycol ethers, alkoxylated triglycerides, alk(en)yl oligoglycosides, fatty acid-N-alkyl glucamides, protein hydrolyzates (more particularly wheat-based vegetable products), polyol fatty acid esters, sugar esters, sorbitan esters and polysorbates. Where the nonionic surfactants contain polyglycol ether chains, they may have a conventional homolog distribution although they preferably have a narrow homolog distribution. Preferred other nonionic surfactants are fatty alcohol polyglycol ethers, alkyl oligoglucosides, fatty acid-N-alkyl glucamides, hydroxy mixed ethers and/or mixed ethers.

In a preferred embodiment of the invention, the other nonionic surfactants (component d) used are alkyl and alkenyl oligoglycosides corresponding to formula (VII):

$$R^{12}O—[G]_q \quad (VII)$$

in which $R^{12}$ is an alkyl and/or alkenyl group containing 4 to 22 carbon atoms, G is a sugar unit containing 5 or 6 carbon atoms and q is a number of 1 to 10. They may be obtained by the relevant methods of preparative organic chemistry.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index q in general formula (VII) indicates the degree of oligomerization (DP), i.e. the distribution of mono- and oligoglycosides, and is a number of 1 to 10. Whereas q in a given compound must always be an integer and, above all, may assume a value of 1 to 6, the value q for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerzation of less than 1.7 and, more particularly, between 1.2 and 1.4 are preferred from the applicational point of view. The alkyl or alkenyl group $R^{12}$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl group $R^{12}$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut fatty alcohol with a DP of 1 to 3 are preferred.

Another group of preferred other nonionic surfactants are fatty acid-N-alkyl polyhydroxyalkylamides which correspond to formula (VIII):

$$R^{14}CO—\overset{\overset{\displaystyle R^{13}}{|}}{N}—[Z] \quad (VIII)$$

where $R^{14}CO$ is an aliphatic acyl group containing 6 to 22 carbon atoms, $R^{13}$ is an alkyl or hydroxyalkyl group containing 1 to 4 carbon atoms and [Z] is a linear or branched polyhydroxyalkyl group containing 3 to 12 carbon atoms and 3 to 10 hydroxyl groups. The fatty acid-N-alkyl polyhydroxyalkylamides are known compounds which may normally be obtained by reductive amination of a reducing sugar with an alkylamine or an alkanol-amine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8 (1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxyalkylamides are fatty acid-N alkyl glucamides which correspond to formula (IX):

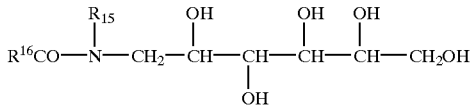

(IX)

Preferred fatty acid-N-alkyl polyhydroxyalkylamides are glucamides corresponding to formula (IX) in which $R^{15}$ is an alkyl group and $R^{16}CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid-N-alkyl glucamides (IX) obtained by reductive amination of glucose with methylamine and subsequent acylation with lauric acid or $C_{12/14}$ cocofatty acid or a corresponding derivative are particularly preferred. In addition, the polyhydroxyalkylamides may also be derived from maltose and palatinose.

Fatty alcohol polyglycol ethers are particularly preferred as the other nonionic surfactants. The fatty alcohol polyglycol ethers are products of the addition of alkylene oxides containing 2 to 4 carbon atoms (ethylene oxide, propylene oxide and/or butylene oxide) onto fatty alcohols containing 6 to 22 carbon atoms. In one embodiment, the fatty alcohol polyglycol ethers are products of the addition; of first ethylene oxide and then optionally propylene oxide and/or butyl ene oxide onto fatty alcohols. Within this embodiment, particularly suitable fatty alcohol polyethylene glycol/polypropylene or polybutylene glycol ethers are those corresponding to formula (X):

$$R^{17}O(CH_2CH_2O)_r[MO]_sH \qquad (X)$$

in which $R^{17}$ is an alkyl and/or alkylene group containing 8 to 22 carbon atoms, MO is a propylene oxide, and/or a butylene oxide unit, r is a number of 1 to 15 and s is 0 or a number of 1 to 10.

Fatty alcohol polyethylene glycol/polypropylene or polybutylene glycol ethers corresponding to formula (X) may be produced, for example, in accordance with European patent application EP-A2-161 537 or DE-A1 39 28 602 and DE-A1 39 28 600.

Particularly suitable representatives are those of formula (X) in which $R^{17}$ is an aliphatic, saturated, linear or branched alkyl group containing 8 to 18 carbon atoms, r is a number of 3 to 10 and s=0. These ethers are products of the addition of 3 to 10 moles ethylene oxide onto fatty alcohols. Suitable fatty alcohols are alcohols based on fats and oils, such as caproic, caprylic, lauryl, myristyl and stearyl alcohol and the technical mixtures thereof obtained in the high-pressure hydrogenation of technical methyl esters based on fats and oils. Also suitable are monohydric branched alcohols, so-called oxo alcohols, which generally carry 2 to 4 methyl groups as branches and are produced by the oxo process and so-called Guerbet alcohols which are branched in the 2-position by an alkyl group. Suitable Guerbet alcohols are 2-ethyl hexanol, 2-butyl octanol, 2-hexyl decanol and/or 2-octyl dodecanol. These oxo alcohols and Guerbet alcohols are also regarded as fatty alcohols in the context of the invention.

Other suitable compounds of formula (X) are those in which $R^{17}$ is an aliphatic, saturated, linear or branched alkyl group containing 8 to 18 carbon atoms, r is a number of 2 to 7 and s is a number of 3 to 7. These compounds are addition products of monohydric alcohols of the described type alkoxylated first with 2 to 7 moles ethylene oxide and then with 3 to 7 moles propylene and/or butylene oxide.

In another preferred embodiment, the rinse agents contain fatty alcohol polyglycol ethers which are products of the addition of first propylene oxide and then optionally ethylene oxide. Accordingly, the ethers in question are fatty alcohol polypropylene glycol/polyethylene glycol ethers which preferably correspond to formula (XI):

$$R^{18}O[CH_2(CH_3)CHO]_u(CH_2CH_2O)_wH \qquad (XI)$$

in which $R^{18}$ is an alkyl and/or alkenyl group containing 8 to 22 carbon atoms, u is a number of 1 to 10 and w is a number of 0 to 15.

Compounds such as these are described, for example, in DE-A1 43 23 252. Particularly preferred representatives of the compounds corresponding to formula (XI) are those in which $R^{18}$ is an aliphatic, saturated, linear or branched alkyl chain containing 8 to 18 carbon atoms, u is a number of 1 to 5 and w is a number of 1 to 6. These compounds are preferably products of the addition of 1 to 5 moles propylene oxide and 1 to 6 moles ethylene oxide onto monohydric alcohols of the type already described.

Particularly preferred other nonionic surfactants also include the so-called mixed ethers. The mixed ethers are products of the addition of ethylene oxide and/or propylene oxide onto fatty alcohols which are end-capped by subsequent reaction with an alkyl chloride in the presence of bases. Particularly suitable mixed ethers are those which have been produced by end-capping with an alkyl halide containing 1 to 8 carbon atoms and more particularly with 1 to 4 carbon atoms of the fatty alcohol polyglycol ethers corresponding to formula (X) and/or (XI). Typical examples are mixed ethers based on a technical $C_{12/18}$ or $C_{12/14}$ cocoalcohol onto which 5 to 10 moles of ethylene oxide have been added and which have been end-capped with a methyl group or with a butyl group, for example Dehypon® LS-54, LS-104, LT-54, LS-104, LS-531, Henkel KGaA, D üsseldorf/FRG.

Other particularly preferred nonionic surfactants are so-called hydroxy mixed ethers which have been produced by reaction of 1,2-epoxyalkanes with mono-, di- and/or polyhydric alkoxylated alcohols. Preferred hydroxy mixed ethers correspond to formula (XII):

$$R^{19}O[CH_2CH(CH_3)O]_j(CH_2CHR^{20}O)_k[CH_2CH(OH)R^{21}]_l \qquad (XII)$$

in which $R^{19}$ is an alkyl and/or alkylene group containing 4 to 18 carbon atoms, $R^{20}$ is hydrogen or a methyl or ethyl group, $R^{21}$ is an alkyl group containing 2 to 22 carbon atoms, j is 0 or a number of 1 to 10, k is a number of 1 to 30 and l is the number 1,2 or 3.

Hydroxy mixed ethers corresponding to formula (VII) are known from the literature and are described, for example, in WO 96/12001. They are produced by reaction of 1,2-epoxyalkanes ($R^{21}CHOCH_2$) with mono-, di- and/or trihydric alkoxylated alcohols. According to the invention, hydroxy mixed ethers derived from alkoxylates of monohydric alcohols (l=1) with the formula $R^{19}$—OH are preferred. Suitable examples of alcohols have already been given in connection with the fatty alcohol polyglycol ethers.

The alcohols are used in the form of their alkoxylates which are produced in known manner by reaction of the alcohols with ethylene oxide, propylene oxide and/or butylene oxide. Alkoxylates of alcohols which have been alkoxylated with 10 to 25 moles of ethylene oxide ($R^{20}$=hydrogen, j=0, k=10 to 25) or with 1 to 3 moles of propylene oxide and then with 10 to 25 moles of ethylene oxide ($R^{20}$=hydrogen, j=1 to 3, k=10 to 25) are preferably used.

Most particularly suitable hydroxy mixed ethers corresponding to formula (XII) are those in which $R^{19}$ is a saturated linear alkyl chain containing 8 to 14 carbon atoms, $R^{20}$ is hydrogen, $R^{21}$ is a saturated linear alkyl chain containing 8 to 12 carbon atoms, j is 0 or a number of 1 to 3, k is a number of 10 to 25 and l is the number 1. Hydroxy mixed ethers such as these are described in detail in DE-A1 37 23 323.

If desired, the multipurpose cleaners according to the invention may contain other amphoteric or zwitterionic surfactants, for example aminopropionates, aminoglycinates and sulfobetaines, as an additional component e). Within this group, the aminoglycinates described in detail in EP-B-0 689 582, for example, are particularly preferred.

The multipurpose cleaners according to the invention preferably contain

- alkoxylated carboxylic acid esters (component a) in quantities of 1 to 80% by weight and preferably in quantities of 5 to 25% by weight;
- betaines and/or amine oxides (component b) in quantities of 1 to 20% by weight and preferably in quantities of 3 to 10% by weight;
- anionic surfactants (component c) in quantities of 0 to 70% by weight and preferably in quantities of 0 to 50% by weight;
- other nonionic surfactants (component d) in quantities of 0 to 80% by weight and preferably in quantities of 10 to 75% by weight;
- other amphoteric or zwitterionic surfactants (component e) in quantities of 0 to 20% by weight and preferably in quantities of 0 to 10% by weight, based on the surfactant mixture in the multipurpose cleaner, the percentages by weight being calculated as active substance and with the proviso that they add up to 100% by weight.

The multipurpose cleaners according to the invention contain components a) and b), preferably in combination with d) and optionally in admixture with c) and/or e), in quantities of 3 to 20% by weight and preferably in quantities of 5 to 15% by weight, expressed as active substance and based on the multipurpose cleaner. The balance to 100% by weight is made up by auxiliaries and water.

The multipurpose cleaners according to the invention may contain, for example, solubilizers, such as ethanol, isopropyl alcohol, ethylene glycol, diethylene glycol or preferably butyl diglycol, foam regulators, for example soap, soluble builders, for example citric acid or sodium citrate, EDTA or NTA, and abrasives as auxiliaries. In many cases, an additional bactericidal effect is required so that the multipurpose cleaners may contain cationic surfactants or biocides, for example glucoprotamine. The multipurpose cleaners according to the invention may be both alkaline (pH>7.5) and acidic (pH<6.5).

The present invention also relates to the use of mixtures of alkoxylated carboxylic acid esters and betaines and/or amine oxides as a dermatologically safe surfactant mixture for the production of multipurpose cleaners.

EXAMPLES

Cleaning performance was tested by the method described in "Seifen-Öle-Fette-Wachse", 112, 371 (1986) which gives highly reproducible results. In this test, the cleaner to be tested is applied to an artificially soiled plastic surface in the form of a 1% by weight aqueous solution (10 g/l). The artificial soil used for the diluted cleaner was a mixture of soot, machine oil, triglyceride of saturated fatty acids and low-boiling aliphatic hydrocarbon. The test surface measuring 26×28 cm was uniformly coated with 2 g of the artificial soil using a surface coater.

A plastic sponge was soaked with water, squeezed out and mechanically wiped over the test surface to which 10 ml of the 1% cleaning solution to be tested had been applied. After 10 wiping movements, the cleaned test surface was held under running water and the loose soil was removed.

Five examiners visually evaluated the whiteness of the cleaned plastic surface, cleaning performance being better, the lighter the plastic surface appeared. The results are set out in Table 1. Examples 1 to 4 correspond to the invention, C1 is a standardized Comparison Example. A score of "better than standard" was awarded where at least 4 out of 5 examiners visually evaluated the plastic surface as lighter.

TABLE 1

Cleaning performance of the multipurpose cleaners on plastic surfaces (figures = % by weight active substance)

| | 1 | 2 | 3 | Standard |
|---|---|---|---|---|
| $C_{8-18}$ fatty acid $(EO)_{10}$ methyl ester | 4.5 | 1.0 | 1.0 | — |
| $C_{12-18}$ fatty alcohol $(EO)_7$ | — | 3.5 | 2.5 | 4.5 |
| $C_{8-10}$ fatty alcohol $(PO)_1(EO)_{22}$ end-capped with α-decene epoxide | — | — | 1.0 | — |
| Cocoamidopropyl amine oxide | 0.5 | 0.5 | 0.5 | 0.5 |
| $C_{8/10}$ alkyl polyglucoside (DP 1.4) | 1.0 | 1.0 | 1.0 | 1.0 |
| Solvent | 5.0 | 5.0 | 5.0 | 5.0 |
| Deionized water | to 100 | to 100 | to 100 | to 100 |
| Cleaning performance | Better than standard | Better than standard | Better than standard | Better than standard |

What is claimed is:

1. A multipurpose cleaner comprising (a) an alkoxylated carboxylic acid ester corresponding to the formula (I):

$$R^1\underset{\underset{O}{\|}}{C}(OAlk)_nOR^2 \qquad (I)$$

wherein $R^1CO$ is an aliphatic acyl group, AlkO is $CH_2CH_2O$, $CHCH_3CH_2O$, $CH_2CHCH_3O$, or a combination thereof, n is a number from 1 to 20 and $R^2$ is an aliphatic alkyl group, and (b) a betaine, an amine oxide or a combination thereof.

2. The multipurpose cleaner of claim 1 wherein $R^1CO$ is an aliphatic acyl group having from 8 to 18 carbon atoms, AlkO is a $CH_2CH_2O$ group, n has an average value of from about 5 to about 15 and $R^2$ is a methyl group.

3. The multipurpose cleaner of claim 1 wherein the betaine is a compound of the formula (II):

(II)

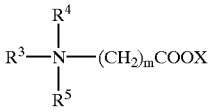

wherein $R^3$ is an alkyl group or an alkenyl group having from about 6 to about 22 carbon atoms or a combination thereof; $R^4$ is hydrogen or an alkyl group having from 1 to 4 carbon atoms; $R^5$ is an alkyl group having from 1 to 4 carbon atoms; m is a number from 1 to 6 and X is an alkali metal ion, an alkaline earth metal ion or ammonium ion.

4. The multipurpose cleaner of claim 1 wherein the betaine is a compound of the formula (III):

(III)

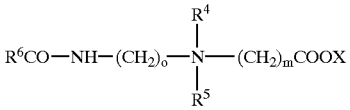

wherein $R^6CO$ is an aliphatic acyl group having from 6 to 22 carbon atoms and 0 or 1 to 3 double bonds, o is a number from 1 to 3 and each of $R^4$, $R^5$, m and X is as defined above for formula (II).

5. The multipurpose cleaner of claim 1 wherein the amine oxide is, a compound of the formula (V):

(V)

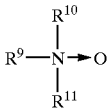

wherein $R^9$ is a linear or branched alkyl group having from 12 to 18 carbon atoms; each of $R^{10}$ and $R^{11}$ is independently the same as $R^9$ or represent an optionally hydroxy-substituted alkyl group having from 1 to 4 carbon atoms.

6. The multipurpose cleaner of claim 1 wherein the weight ratio of components a) and b) is from about 30:70 to about 70:30.

7. The multipurpose cleaner of claim 1 further comprising an anionic surfactant.

8. The multipurpose cleaner of claim 7 wherein the anionic surfactant is an alkyl sulfate, an alkyl ether sulfate or a combination thereof.

9. The multipurpose cleaner of claim 1 further comprising an additional nonionic surfactant.

10. The multipurpose cleaner of claim 9 wherein the nonionic surfactant is selected from the group consisting of a fatty alcohol polyglycol ether, an alkyl oligoglucoside, a fatty acid-N-alkyl glucamide, a hydroxy mixed ether, a mixed ether and a combination thereof.

11. The multipurpose cleaner of claim 1 further comprising an amphoteric or zwitterionic surfactant.

12. The multipurpose cleaner of claim 11 wherein the amphoteric or zwitterionic surfactant is an aminoglycinate.

13. A multipurpose cleaner comprising from about 1 to about 80% by weight of an alkoxylated carboxylic acid ester; from about 1 to about 20% by weight of a betaine or an amine oxide; from 0 to about 70% by weight of an anionic surfactant; from 0 to about 80% by weight of additional nonionic surfactant; from 0 to about 20% by weight of an additional amphoteric or zwitterionic all weights based on the total weight of the surfactant mixture.

14. The multipurpose cleaner of claim 13 wherein the amount of alkoxylated carboxylic acids ester is from about 5 to about 25% by weight; the amount of the betaine or amine oxides is from about 3 to 10% by weight; the amount of anionic surfactant is from 0 to 50% by weight; the amount of additional nonionic surfactant is from about 10 to about 75% by weight; the amount of additional amphoteric or zwitterionic surfactant is from about 0 to about 10% by weight.

* * * * *